US009514896B2

(12) United States Patent
Naka et al.

(10) Patent No.: US 9,514,896 B2
(45) Date of Patent: Dec. 6, 2016

(54) ELECTROMAGNETIC CONTACTOR

(71) Applicants: FUJI ELECTRIC FA COMPONENTS & SYSTEMS CO., LTD., Chuo-ku, Tokyo (JP); FUJI ELECTRIC CO., LTD., Kawasaki-shi, Kanagawa (JP)

(72) Inventors: Yasuhiro Naka, Kounosu (JP); Kouetsu Takaya, Kounosu (JP); Kenji Suzuki, Kounosu (JP)

(73) Assignees: FUJI ELECTRIC FA COMPONENTS & SYSTEMS CO., LTD., Tokyo (JP); FUJI ELECTRIC CO., LTD., Kawasaki-shi (JP)

( * ) Notice: Subject to any disclaimer, the term of this patent is extended or adjusted under 35 U.S.C. 154(b) by 160 days.

(21) Appl. No.: 14/505,009

(22) Filed: Oct. 2, 2014

(65) Prior Publication Data

US 2015/0054606 A1 Feb. 26, 2015

Related U.S. Application Data

(63) Continuation of application No. PCT/JP2013/002991, filed on May 9, 2013.

(30) Foreign Application Priority Data

Jun. 8, 2012 (JP) ..... 2012-131236

(51) Int. Cl.
*H01H 1/54* (2006.01)
*H01H 50/36* (2006.01)
(Continued)

(52) U.S. Cl.
CPC ..... *H01H 1/54* (2013.01); *H01H 50/36* (2013.01); *H01H 50/42* (2013.01); *H01H 50/163* (2013.01);
(Continued)

(58) Field of Classification Search
CPC ..... H01H 50/36; H01H 50/42; H01H 1/54; H01H 2050/025; H01H 2001/545; H01H 50/546
See application file for complete search history.

(56) References Cited

U.S. PATENT DOCUMENTS 4,940,958 A 7/1990 Ootsuka
5,959,519 A 9/1999 Gobel et al.
(Continued)

FOREIGN PATENT DOCUMENTS

CN 201171024 12/2008
CN 101341564 A 1/2009
(Continued)

OTHER PUBLICATIONS

China Patent Office, "Office Action for CN 201380018962.3," Nov. 13, 2015.
(Continued)

*Primary Examiner* — Bernard Rojas
(74) *Attorney, Agent, or Firm* — Manabu Kanesaka

(57) ABSTRACT

The electromagnetic contactor has a pair of fixed contacts disposed to maintain a predetermined interval and a movable contact disposed so as to be attachable to and detachable from the pair of fixed contacts, and an electromagnet unit that drives the movable contact. The electromagnet unit has a magnetic yoke enclosing a plunger drive portion, a movable plunger having a leading end protruding through an aperture formed in the magnetic yoke and biased by a return spring, an annular permanent magnet fixedly disposed so as to enclose a peripheral flange portion formed on a protruding end side of the movable plunger and magnetized in a direction in which the movable plunger can move, and an auxiliary yoke disposed on the annular permanent magnet at a side opposite to that of the magnetic yoke and regulating
(Continued)

a movement of the peripheral flange portion of the movable plunger.

3 Claims, 11 Drawing Sheets

(51) Int. Cl.
*H01H 50/42* (2006.01)
*H01H 50/54* (2006.01)
*H01H 50/02* (2006.01)
*H01H 50/16* (2006.01)

(52) U.S. Cl.
CPC ..... *H01H 50/546* (2013.01); *H01H 2001/545* (2013.01); *H01H 2050/025* (2013.01)

(56) References Cited

U.S. PATENT DOCUMENTS

| | | | | |
|---|---|---|---|---|
| 6,337,612 | B1 | 1/2002 | Kim et al. | |
| 8,159,807 | B2 | 4/2012 | Pohl | |
| 8,222,979 | B2 | 7/2012 | Minowa et al. | |
| 8,222,980 | B2 * | 7/2012 | Yamagata | H01H 50/023 335/126 |
| 2009/0322453 | A1 | 12/2009 | Kawaguchi et al. | |
| 2010/0060392 | A1 * | 3/2010 | Cho | H01H 50/023 335/124 |
| 2010/0289604 | A1 * | 11/2010 | Kojima | H01H 9/443 335/133 |
| 2015/0022295 | A1 | 1/2015 | Takaya et al. | |

FOREIGN PATENT DOCUMENTS

| | | | | |
|---|---|---|---|---|
| CN | 101421809 | A | 4/2009 | |
| EP | 2843682 | A1 | 3/2015 | |
| GB | 2325567 | A | 11/1998 | |
| JP | S54-61262 | U | 4/1979 | |
| JP | H01-268005 | A | 10/1989 | |
| JP | H02-091901 | A | 3/1990 | |
| JP | 2000-331587 | A | 11/2000 | |
| JP | 2005-209839 | A | 8/2005 | |
| JP | 2010-062079 | A | 3/2010 | |
| JP | 2013-222561 | A | 10/2013 | |
| JP | WO 2013183224 | A1 * | 12/2013 | H01H 50/36 |

OTHER PUBLICATIONS

PCT, "International Search Report for International Application No. PCT/JP2013/002991".

Europe Patent Office, "Search Report for European Patent Application No. 13800184.7," Mar. 29, 2016.

* cited by examiner

ELECTROMAGNETIC CONTACTOR

CROSS REFERENCE TO RELATED APPLICATION

The present application is a continuation application of an International Application No. PCT/JP2013/002991 filed May 9, 2013, and claims priority from Japanese Application No. 2012-131236 filed Jun. 8, 2012.

TECHNICAL FIELD

The present invention relates to an electromagnetic contactor including fixed contacts, a movable contact attachable to and detachable from the fixed contacts, and an electromagnet unit that drives the movable contact.

BACKGROUND ART

A polarized electromagnet device that drives a movable iron core portion against the return force of a spring using the combined suctioning force of the suctioning force of permanent magnets and the suctioning force from an exciting coil, wherein one magnetic pole face of a permanent magnet contacts each of two central pieces of a reverse C-shaped fixed iron core, while the other magnetic pole face contacts central pieces of a pair of L-shaped polarized plates disposed on the outer side of the exciting coil inside the fixed iron core, has been proposed as a drive device that drives a movable contact disposed so as to be attachable to and detachable from fixed contacts in this kind of electromagnetic contactor (for example, refer to PTL 1 and PTL 2).

CITATION LIST

Patent Literature

PTL 1: JP-A-2-91901
PTL 2: U.S. Pat. No. 5,959,519

SUMMARY OF INVENTION

Technical Problem

However, in the heretofore known examples described in PTL 1 and PTL 2, the pair of L-shaped polarized plates is disposed on the outer side of the exciting coil, and each of the permanent magnets is disposed with bilateral symmetry between plate portions of the polarized plates opposing the exciting coil and the fixed iron core. Consequently, there is an unresolved problem that two permanent magnets are necessary, each being disposed on the left and right, the distance between the permanent magnets and the portion on which the suctioning force of the movable iron core acts is long, and it is therefore not possible to use the magnetic force of the permanent magnets efficiently.

Therefore, the invention, focusing on the unresolved problem of the heretofore known examples, has an object of providing an electromagnetic contactor such that, without using a plurality of permanent magnets, it is possible to secure the necessary magnetic force with one permanent magnet, and to use the magnetic force of the permanent magnet efficiently.

Solution to Problem

In order to achieve the object, a first aspect of an electromagnetic contactor according to the invention includes a pair of fixed contacts disposed to maintain a predetermined interval and a movable contact disposed so as to be attachable to and detachable from the pair of fixed contacts, and an electromagnet unit that drives the movable contact. Further, the electromagnet unit includes a magnetic yoke enclosing a plunger drive portion, a movable plunger having a leading end protruding through an aperture formed in the magnetic yoke, the movable plunger supporting the movable contact via a connecting shaft and being biased by a return spring, an annular permanent magnet fixedly disposed so as to enclose a peripheral flange portion formed on a protruding end side of the movable plunger and magnetized in a direction in which the movable plunger can move, and an auxiliary yoke disposed on a side of the annular permanent magnet opposite to that of the magnetic yoke and regulating a movement of the peripheral flange portion of the movable plunger. Furthermore, the auxiliary yoke includes a stepped plate portion formed in a central portion of a flat plate portion and having an aperture through which the connecting shaft is inserted.

According to this configuration, the permanent magnet is provided so as to enclose the peripheral flange portion of the movable plunger, thereby it is possible to cause the magnetic force of the annular permanent magnet to act without leakage on the peripheral flange portion of the movable plunger. Consequently, it is possible to use the magnetic force of the annular permanent magnet efficiently. Also, by causing suctioning force moving the movable contact in the releasing direction to act on the movable plunger, it is possible to reduce the biasing force of the return spring. Thereby, it is possible to reduce the magnetomotive force of the exciting coil, and thus reduce the size of the electromagnet unit. Also, in a released state, it is possible to suction the peripheral flange portion of the movable plunger with the magnetic force of the permanent magnet, and thus possible to secure high malfunction resistance performance at the time of releasing. Furthermore, as a stepped plate portion is formed in the auxiliary yoke with which the peripheral flange portion of the movable plunger contacts, it is possible to increase the rigidity of the auxiliary yoke itself, and thus possible to prevent deformation of the auxiliary yoke and accurately regulate the stroke of the movable plunger. Also, as the magnetic force of the annular permanent magnet acts directly on the peripheral flange portion of the movable plunger via the auxiliary yoke, it is possible to suppress leakage magnetic flux and use the magnetic force of the annular permanent magnet more efficiently.

Also, in a second aspect of the electromagnetic contactor according to the invention, the auxiliary yoke is formed such that the flat plate portion and stepped plate portion are integrally formed by pressing.

According to the second aspect, the auxiliary yoke is molded integrally by pressing, thereby it is possible to easily carry out fabrication of the auxiliary yoke.

Also, in a third aspect of the electromagnetic contactor according to the invention, a height of the stepped plate portion is determined based on the stroke necessary for the movable plunger.

According to the third aspect, it is possible to regulate the stroke necessary for the movable plunger with the height of the stepped plate portion of the auxiliary yoke.

Advantageous Effects of Invention

According to the invention, it is possible to suction the peripheral flange portion of the movable plunger with one annular permanent magnet, and thus possible to reduce the number of parts and achieve a reduction in cost.

Also, as the annular permanent magnet is disposed so as to enclose the peripheral flange portion of the movable plunger, it is possible to dispose the annular permanent magnet in the vicinity of the position in which the suctioning force is caused to act, and thus possible to use the magnetic force of the annular permanent magnet efficiently.

Further, as the magnetic force of the annular permanent magnet is caused to act directly on the peripheral flange portion of the movable plunger by the auxiliary yoke, it is possible to suppress leakage magnetic flux, and thus use the magnetic force of the annular permanent magnet more efficiently. Also, by a stepped plate portion formed in the auxiliary yoke, it is possible to increase the rigidity of the auxiliary yoke itself, and thus accurately regulate the stroke of the movable plunger.

Furthermore, it is possible to cause the suctioning force of the annular permanent magnet to act so as to suction the movable plunger in a released state, and thus possible to commensurately suppress the biasing force of the return spring that causes the movable plunger to return to a released state. Thereby, by reducing the magnetomotive force of the exciting coil, it is possible to reduce the height of the electromagnet unit, and thus possible to reduce the overall size of the electromagnetic contactor. At the same time, it is possible to suction the movable plunger with the permanent magnet at the time of releasing, and thus reliably prevent the movable contact from unintentionally contacting with the pair of fixed contacts due to vibration, shock, or the like.

BRIEF DESCRIPTION OF DRAWINGS

FIGS. 4A and 4B are diagrams, each showing an auxiliary yoke, wherein FIG. 4A is a sectional view and FIG. 4B is a perspective view.

FIGS. 5A and 5B are diagrams, each illustrating a movable plunger suctioning action by a permanent magnet, wherein FIG. 5A is a partial sectional view showing a released state and FIG. 5B is a partial sectional view showing an engaged state.

FIGS. 8A and 8B are diagrams, each showing a modification example of a contact mechanism in the contact device of the invention, wherein FIG. 8A is a sectional view and FIG. 8B is a perspective view.

FIGS. 9A and 8B are diagrams, each showing another modification example of the contact mechanism in the contact device of the invention, wherein FIG. 9A is a sectional view and FIG. 9B is a perspective view.

FIGS. 10A and 10B are diagrams, each showing a modification example of the cylindrical auxiliary yoke of an electromagnet unit, wherein FIG. 9A is a sectional view and FIG. 9B is an exploded perspective view.

FIGS. 11A and 11B are diagrams, each showing a modification example of the cylindrical auxiliary yoke of the electromagnet unit, wherein FIG. 11A is a sectional view and FIG. 11B is an exploded perspective view.

DESCRIPTION OF EMBODIMENTS

Hereafter, a description will be given, based on the drawings, of an embodiment of the invention.

Figure 1:
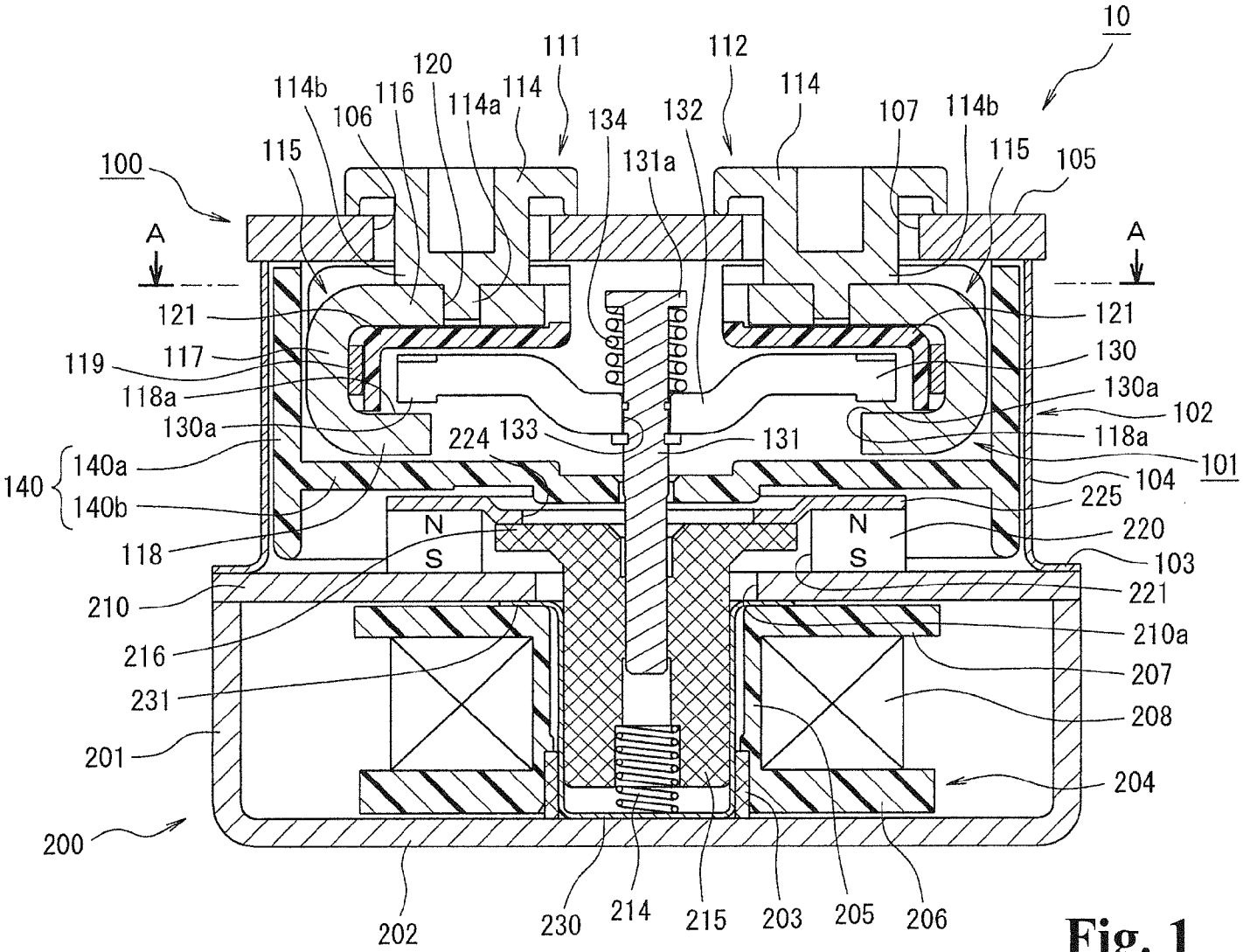
FIG. 1 is a sectional view showing an embodiment of an electromagnetic contactor according to the invention.
Figure 2B:
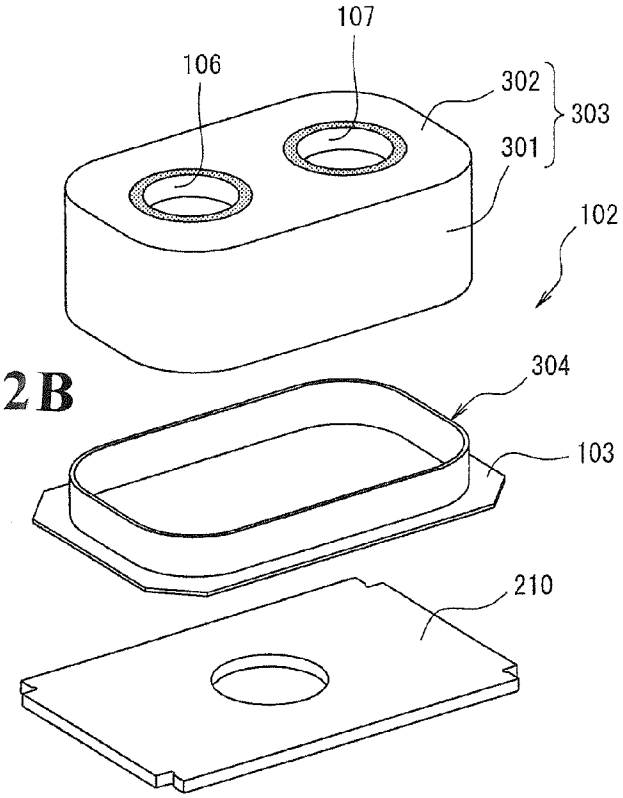
FIGS. 2A and 2B are exploded perspective views, each showing an arc extinguishing chamber.
Figure 2A:
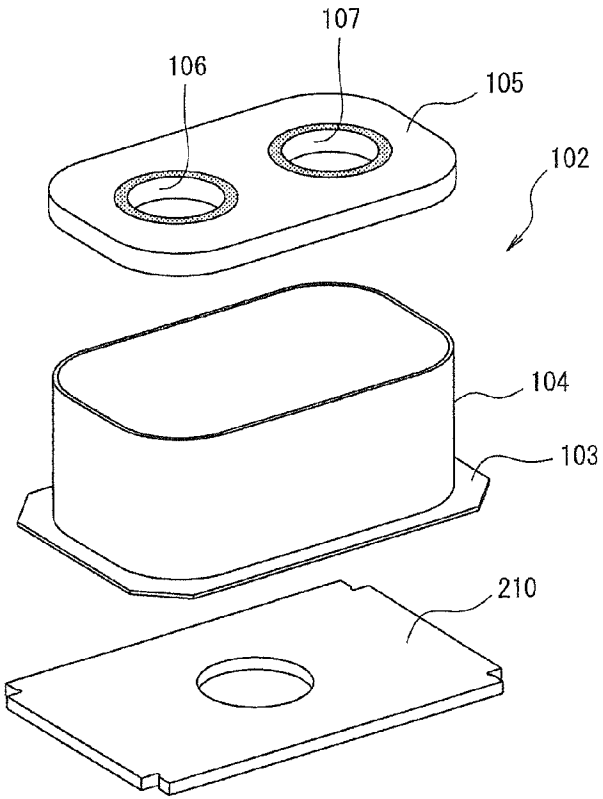

FIG. 1 is a sectional view showing an example of an electromagnetic switch according to the invention, while FIGS. 2A and 2B are exploded perspective views, each showing an arc extinguishing chamber. In FIG. 1 and FIGS. 2A and 2B, 10 is an electromagnetic contactor, and the electromagnetic contactor 10 includes a contact device 100 in which a contact mechanism is disposed, and an electromagnet unit 200 that drives the contact device 100.

The contact device 100 has an arc extinguishing chamber 102 that houses a contact mechanism 101, as clearly shown FIG. 1 and FIGS. 2A and 2B. The arc extinguishing chamber 102 includes a metal tubular body 104 having a flange portion 103 arranged on a metal lower end portion and protruding outward, and a fixed contact support insulating substrate 105 formed of a plate-like ceramic insulating substrate that closes off the upper end of the metal tubular body 104, as shown in FIG. 2A.

The metal tubular body 104 is formed such that the flange portion 103 thereof is seal-joined and fixed to an upper portion magnetic yoke 210 of the electromagnet unit 200, to be described hereafter.

Also, through holes 106 and 107 in which a pair of fixed contacts 111 and 112 is inserted, to be described hereafter, are formed to maintain a predetermined interval in a central portion of the fixed contact support insulating substrate 105. A metalizing process is performed around the through holes 106 and 107 on the upper surface side of the fixed contact support insulating substrate 105, and in a position on the lower surface side that contacts the tubular body 104. In order to carry out the metalizing process, copper foil is formed around the through holes 106 and 107, and in the position that contacts the tubular body 104, in a condition wherein a plurality of the fixed contact support insulating substrate 105 is arranged vertically and horizontally on a flat surface.

The contact mechanism 101, as shown in FIG. 1, includes the pair of fixed contacts 111 and 112 inserted into and fixed in the through holes 106 and 107 of the fixed contact support insulating substrate 105 of the arc extinguishing chamber 102. Each of the fixed contacts 111 and 112 includes a support conductor portion 114, having a flange portion 113 arranged on an upper end and protruding outward, inserted into the through holes 106 and 107 of the fixed contact support insulating substrate 105, and a C-shaped portion 115, the inner side of which is opened, linked to the support conductor portion 114 and disposed on the lower surface side of the fixed contact support insulating substrate 105.

The C-shaped portion 115 is formed in a C-shape of an upper plate portion 116 extending to the outer side along the line of the lower surface of the fixed contact support insulating substrate 105, an intermediate plate portion 117 extending downward from the outer side end portion of the upper plate portion 116, and a lower plate portion 118 extending from the lower end side of the intermediate plate portion 117, parallel with the upper plate portion 116, to the inner side, that is, in a direction facing the fixed contacts 111 and 112, wherein the upper plate portion 116 is added to an L-shape formed by the intermediate plate portion 117 and lower plate portion 118.

Herein, the support conductor portion 114 and C-shaped portion 115 are fixed by, for example, brazing in a condition in which a pin 114*a* protruding on the lower end surface of the support conductor portion 114 is inserted into a through hole 120 formed in the upper plate portion 116 of the C-shaped portion 115. The fixing of the support conductor portion 114 and C-shaped portion 115, not being limited to brazing, may be formed such that the pin 114*a* is fitted into the through hole 120, or an external thread is formed on the pin 114*a* and an internal thread formed in the through hole 120, and the two are screwed together.

Further, an insulating cover 121, made of a synthetic resin material, that regulates arc generation is mounted in each of the C-shaped portions 115 of the fixed contacts 111 and 112. The insulating cover 121 covers the inner peripheral surfaces of the upper plate portion 116 and intermediate plate portion 117 of the C-shaped portion 115.

By mounting the insulating cover 121 on the C-shaped portions 115 of each of the fixed contacts 111 and 112 in this way, only the upper surface side of the lower plate portion 118 of the inner peripheral surface of the C-shaped portion 115 is exposed, and forms a contact portion 118*a*.

Further, a movable contact 130 is disposed such that two end portions thereof are disposed in the C-shaped portion 115 of the fixed contacts 111 and 112. The movable contact 130 is supported by a connecting shaft 131 fixed to a movable plunger 215 of the electromagnet unit 200, to be described hereafter. The movable contact 130 is formed such that a central portion in the vicinity of the connecting shaft 131 protrudes downward, whereby a depressed portion 132 is formed, and a through hole 133 in which the connecting shaft 131 is inserted is formed in the depressed portion 132.

A flange portion 131*a* protruding outward is formed on the upper end of the connecting shaft 131. The connecting shaft 131 is inserted from the lower end side into a contact spring 134, then inserted into the through hole 133 of the movable contact 130, bringing the upper end of the contact spring 134 into contact with the flange portion 131*a*. The movable contact 130 is positioned by, for example, a C-ring 135 so as to obtain a predetermined biasing force from the contact spring 134.

The movable contact 130, in a released state, is in a condition wherein contact portions at two ends thereof and the contact portions 118*a* of the lower plate portions 118 of the C-shaped portions 115 of the fixed contacts 111 and 112 are separated from each other to maintain a predetermined interval. Also, the movable contact 130 is set such that, in an engaged position, the contact portions at the two ends thereof contact the contact portions 118*a* of the lower plate portions 118 of the C-shaped portions 115 of the fixed contacts 111 and 112 at a predetermined contact pressure from the contact spring 134.

Figure 3:
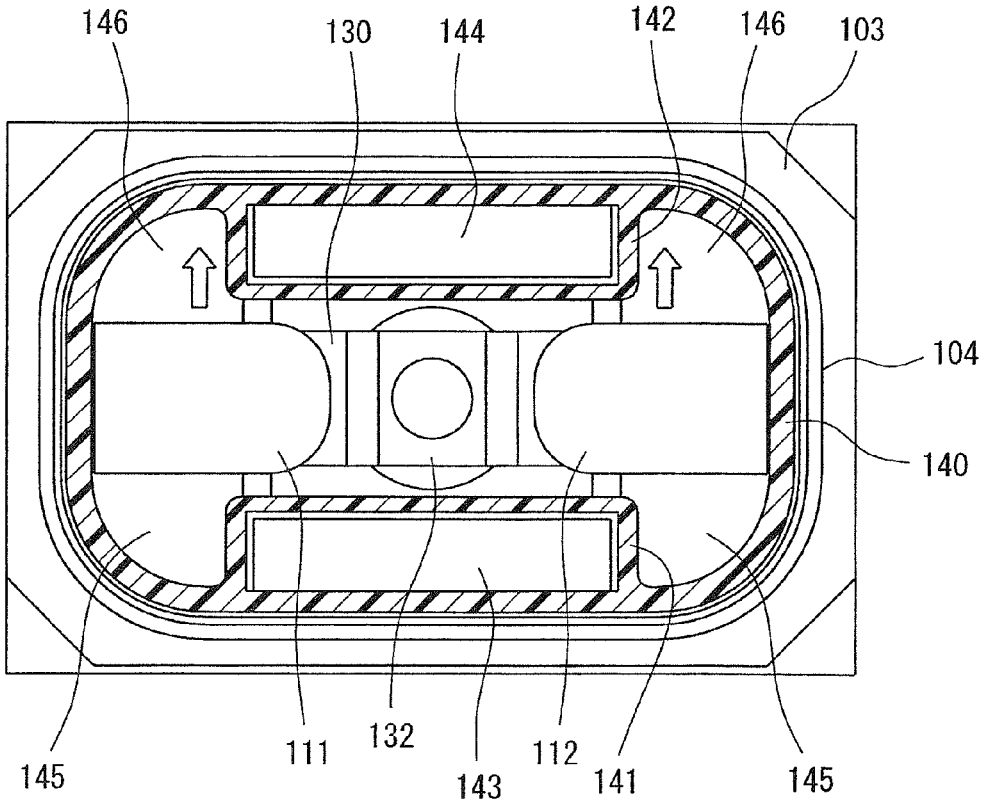
FIG. 3 is a sectional view along an A-A line of FIG. 1.

Furthermore, an insulating cylinder 140 made of, for example, a synthetic resin is disposed on the inner peripheral surface of the metal tubular body 104 of the arc extinguishing chamber 102, as shown in FIG. 3, and magnet housing pockets 141 and 142 are formed in positions on the insulating cylinder 140 facing the side surfaces of the movable contact 130. Arc extinguishing permanent magnets 143 and 144 are inserted into and fixed in the magnet housing pockets 141 and 142.

The arc extinguishing permanent magnets 143 and 144 are magnetized in a thickness direction such that mutually opposing faces thereof are homopolar, such as N-poles. Further, arc extinguishing spaces 145 and 146 are formed on the outer sides in a left-right direction of the magnet housing pockets 141 and 142 respectively.

The electromagnet unit 200, as shown in FIG. 1, has a magnetic yoke 201 of a flattened U-shape relative to the side direction, and a cylindrical auxiliary yoke 203 is fixed in a central portion of a bottom plate portion 202 of the magnetic yoke 201. A spool 204 is disposed as a plunger drive portion on the outer side of the cylindrical auxiliary yoke 203.

The spool 204 includes a central cylinder portion 205 in which the cylindrical auxiliary yoke 203 is inserted, a lower flange portion 206 protruding outward in a radial direction from a lower end portion of the central cylinder portion 205, and an upper flange portion 207 protruding outward in a radial direction from slightly below the upper end of the central cylinder portion 205. Further, an exciting coil 208 is mounted and wound in a housing space formed by the central cylinder portion 205, lower flange portion 206, and upper flange portion 207.

Further, an upper magnetic yoke 210 is fixed between upper ends forming an opened end of the magnetic yoke 201. A through hole 210*a* facing the central cylinder portion 205 of the spool 204 is formed in a central portion of the upper magnetic yoke 210.

Further, the movable plunger 215, in which a return spring 214 is disposed between a bottom portion and the bottom plate portion 202 of the magnetic yoke 201, is disposed in the central cylinder portion 205 of the spool 204 so as to be capable to slide up and down. A peripheral flange portion 216 protruding outward in a radial direction is formed on the movable plunger 215, on an upper end portion protruding upward from the upper magnetic yoke 210.

Also, an annular permanent magnet 220 formed in a ring-form is fixed to the upper surface of the upper magnetic yoke 210 so as to enclose the peripheral flange portion 216 of the movable plunger 215. The annular permanent magnet 220 is of a rectangular external form, and has a through hole 221 enclosing the peripheral flange portion 216 in a central portion thereof. The annular permanent magnet 220 is magnetized in an up-down direction, that is, a thickness direction, such that the upper end side is, for example, an N-pole while the lower end side is an S-pole.

The form of the through hole 221 of the annular permanent magnet 220 corresponds to the form of the peripheral flange portion 216, and the form of the outer peripheral surface can be an arbitrary form such as circular or rectangular. In the same way, the external form of the annular permanent magnet 220, not being limited to rectangular, can also be an arbitrary form such as circular or hexagonal.

Further, an auxiliary yoke 225 having the same external form as the annular permanent magnet 220 is fixed to the upper end surface of the annular permanent magnet 220. The auxiliary yoke 225 includes a rectangular flat plate portion 225*a* fixed to the upper surface of the annular permanent magnet 220, and a stepped plate portion 225*c* protruding downward in a central portion of the rectangular flat plate portion 225*a*, in a central portion of which is formed a central aperture 225*b* through which the connecting shaft 131 is inserted, as shown in FIGS. 4A and 4B.

Herein, the auxiliary yoke 225 is formed such that the central aperture 225*b* and stepped plate portion 225*c* are integrally formed by pressing. By the stepped plate portion 225*c* formed in the auxiliary yoke 225 in this way, it is possible to increase the rigidity of the auxiliary yoke 225, and thus possible to prevent deformation of the auxiliary yoke 225.

Further, in a released state, the peripheral flange portion 216 of the movable plunger 215 contacts the lower surface of the stepped plate portion 225*c* by the elasticity of the return spring 214 and the magnetic force of the annular permanent magnet 220, whereby the engaged position of the movable plunger 215 is regulated.

Figure 4A:
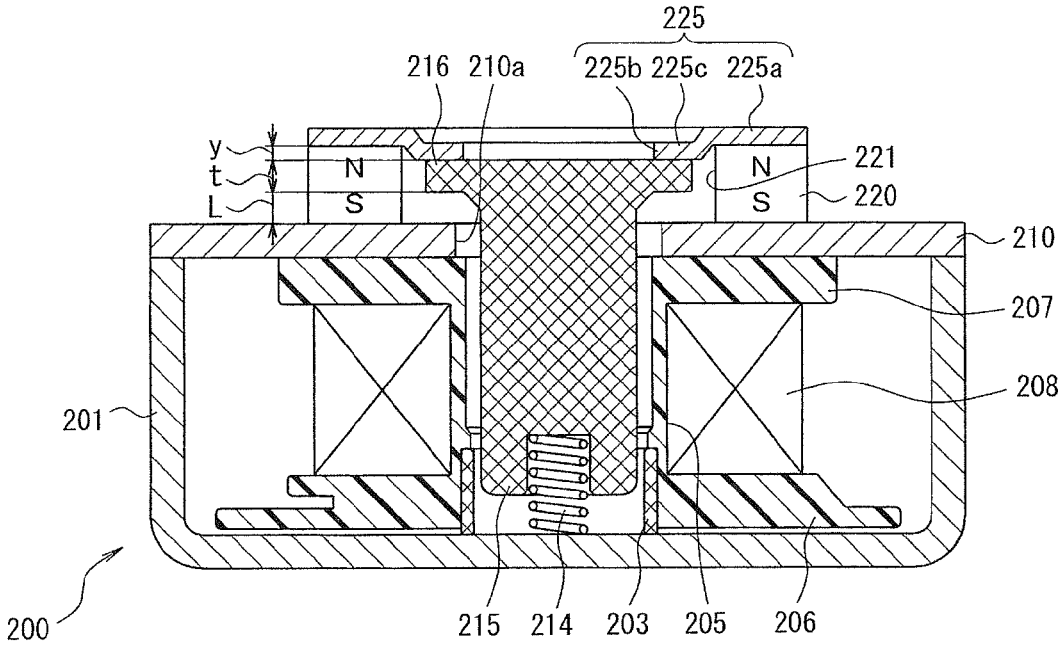
Figure 4B:
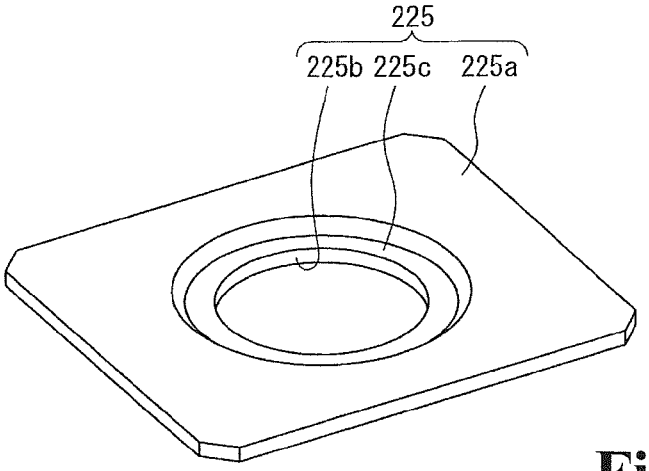

Herein, a thickness T of the annular permanent magnet 220 is set to a value (T=L+t+y) wherein a stroke L of the movable plunger 215, a thickness t of the peripheral flange portion 216 of the movable plunger 215, and a height y from the lower surface of the rectangular flat plate portion 225*a* to the lower surface of the stepped plate portion 225*c* of the auxiliary yoke 225 are added together, as shown in FIG. 4A. Consequently, the thickness T of the annular permanent magnet 220 can be arbitrarily set in accordance with the necessary electromagnetic force, and it is thus possible to regulate the stroke L of the movable plunger 215 with the height y from the rectangular flat plate portion 225*a* to the stepped plate portion 225*c* of the auxiliary yoke 225.

Because of this, it is possible to minimize the cumulative number of parts and form tolerance, affecting the stroke of the movable plunger 215. Consequently, when determining the stroke L of the movable plunger 215, it is possible to determine the thickness T of the annular permanent magnet 220 and the thickness of the peripheral flange portion 216 of the movable plunger 215, and finally to regulate the stroke L with the height y of the auxiliary yoke 225, and thus possible to minimize variation of the stroke L. In particular, this is more advantageous in the case of a small electromagnetic contactor in which the stroke is small.

Also, as the permanent magnet is the annular permanent magnet 220, the number of parts decreases in comparison with a case in which two permanent magnets are disposed with bilateral symmetry, as described in PTL 1 and PTL 2, and a reduction in cost is achieved. Also, as the peripheral flange portion 216 of the movable plunger 215 is disposed in the vicinity of the inner peripheral surface of the through hole 221 formed in the annular permanent magnet 220, there is no waste in a closed circuit passing magnetic flux generated by the annular permanent magnet 220, leakage magnetic flux decreases, and it is possible to use the magnetic force of the permanent magnet efficiently.

Furthermore, the connecting shaft 131 that supports the movable contact 130 is screwed to the upper end surface of the movable plunger 215.

Further, in a released state, the movable plunger 215 is biased upward by the return spring 214, and the upper surface of the peripheral flange portion 216 attains a released position contacting the lower surface of the stepped plate portion 225*c* of the auxiliary yoke 225. In this state, the contact portions 130*a* of the movable contact 130 are moved upward from the contact portions 118*a* of the fixed contacts 111 and 112, causing a state wherein current is interrupted.

In a released state, the peripheral flange portion 216 of the movable plunger 215 is suctioned to the auxiliary yoke 225 by the magnetic force of the annular permanent magnet 220, and by a combination of this magnetic force and the biasing force of the return spring 214, the state in which the movable plunger 215 contacts the auxiliary yoke 225 is maintained, without unplanned downward movement due to external vibration, shock, or the like.

Figure 5A:
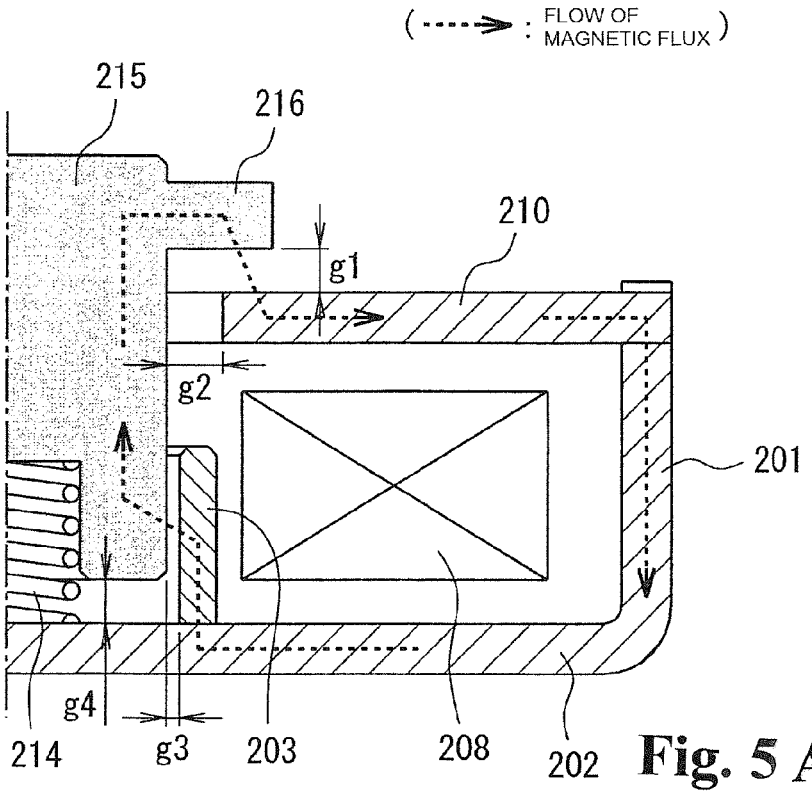

Also, in a released state, as shown in FIG. 5A, relationships between a gap g1 between the lower surface of the peripheral flange portion 216 of the movable plunger 215 and the upper surface of the upper magnetic yoke 210, a gap g2 between the outer peripheral surface of the movable plunger 215 and the through hole 210*a* of the upper magnetic yoke 210, a gap g3 between the outer peripheral surface of the movable plunger 215 and the cylindrical auxiliary yoke 203, and a gap g4 between the lower surface of the movable plunger 215 and the upper surface of the bottom plate portion 202 of the magnetic yoke 201 are set as below.

$g1<g2$ and $g3<g4$

Because of this, when exciting the exciting coil 208 in a released state, the magnetic flux passes from the movable plunger 215 through the peripheral flange portion 216, passes through the gap g1 between the peripheral flange portion 216 and upper magnetic yoke 210, and reaches the upper magnetic yoke 210, as shown in FIG. 5A. A closed magnetic circuit is formed from the upper magnetic yoke 210, through the U-shaped magnetic yoke 201 and through the cylindrical auxiliary yoke 203, to the movable plunger 215.

Because of this, it is possible to increase the magnetic flux density of the gap g1 between the lower surface of the peripheral flange portion 216 of the movable plunger 215 and the upper surface of the upper magnetic yoke 210, a larger suctioning force is generated, and the movable plunger 215 is caused to descend against the biasing force of the return spring 214 and the suctioning force of the annular permanent magnet 220.

Consequently, the contact portions 130*a* of the movable contact 130 connected to the movable plunger 215 via the connecting shaft 131 contact the contact portions 118*a* of the fixed contacts 111 and 112, and a current path is formed from the fixed contact 111, through the movable contact 130, toward the fixed contact 112, thereby creating an engaged state.

Figure 5B:
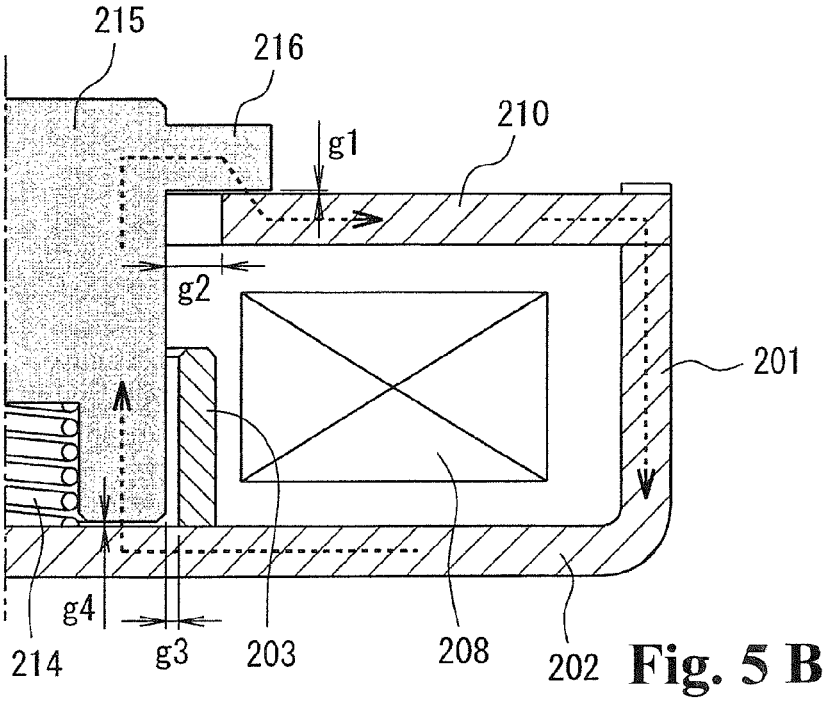

As the lower end surface of the movable plunger 215 comes close to the bottom plate portion 202 of the U-shaped magnetic yoke 201 on the engaged state, as shown in FIG. 5B, the gaps g1 to g4 are as below.

$g1<g2$ and $g3>g4$

Because of this, the magnetic flux generated by the exciting coil 208 passes from the movable plunger 215 through the peripheral flange portion 216, and enters the upper magnetic yoke 210 directly, as shown in FIG. 5B, while a closed magnetic circuit is formed from the upper magnetic yoke 210, through the U-shaped magnetic yoke 201, returning from the bottom plate portion 202 of the U-shaped magnetic yoke 201 directly to the movable plunger 215.

Because of this, a large suctioning force acts in the gap g1 and gap g4, and the movable plunger 215 is held in the down position. Because of this, the state wherein the contact portions 130*a* of the movable contact 130 connected to the movable plunger 215 via the connecting shaft 131 contact the contact portions 118*a* of the fixed contacts 111 and 112 is continued.

Further, the movable plunger 215 is covered with a cap 230 formed in a bottomed tubular form made of a non-magnetic body, as shown in FIG. 1, and a flange portion 231 formed extending outward in a radial direction on an opened end of the cap 230 is seal-joined to the lower surface of the upper magnetic yoke 210. Thereby, a hermetic receptacle, wherein the arc extinguishing chamber 102 and the cap 230 communicate via the through hole 210*a* of the upper magnetic yoke 210, is formed. Further, a gas such as hydrogen gas, nitrogen gas, a mixed gas of hydrogen and nitrogen, air, or $SF_6$ is encapsulated inside the hermetic receptacle formed by the arc extinguishing chamber 102 and the cap 230.

Next, a description will be given of an operation of the heretofore described embodiment.

Herein, it is assumed that the fixed contact 111 is connected to, for example, a power supply source that supplies a large current, while the fixed contact 112 is connected to a load.

In this state, the exciting coil 208 in the electromagnet unit 200 is in a non-exciting state, and is in a released state wherein no exciting force causing the movable plunger 215 to descend is generated in the electromagnet unit 200. In this released state, the movable plunger 215 is biased in an upward direction away from the upper magnetic yoke 210 by the return spring 214.

Simultaneously with this, a suctioning force created by the magnetic force of the annular permanent magnet 220 acts on the auxiliary yoke 225, and the peripheral flange portion 216 of the movable plunger 215 is suctioned. Because of this, the upper surface of the peripheral flange portion 216 of the movable plunger 215 contacts the lower surface of the stepped plate portion 225*c* of the auxiliary yoke 225.

Because of this, the contact portions 130*a* of the contact mechanism 101 movable contact 130 connected to the movable plunger 215 via the connecting shaft 131 are separated by a predetermined distance upward from the contact portions 118*a* of the fixed contacts 111 and 112. Because of this, the current path between the fixed contacts 111 and 112 is in an interrupted state, and the contact mechanism 101 is in an opened contact state.

In this way, as the biasing force of the return spring 214 and the suctioning force of the annular permanent magnet 220 both act on the movable plunger 215 in the released state, there is no unplanned downward movement of the movable plunger 215 due to external vibration, shock, or the like, and it is thus possible to reliably prevent malfunction.

On the exciting coil 208 of the electromagnet unit 200 excited in the released state, an exciting force is generated in the electromagnet unit 200, and the movable plunger 215 is pressed downward against the biasing force of the return spring 214 and the suctioning force of the annular permanent magnet 220.

At this time, as shown in FIG. 5A, the gap g4 between the bottom surface of the movable plunger 215 and the bottom plate portion 202 of the magnetic yoke 201 is large, and hardly any magnetic flux passes through the gap g4. However, the cylindrical auxiliary yoke 203 faces the lower outer peripheral surface of the movable plunger 215, and the gap g3 between the movable plunger 215 and the cylindrical auxiliary yoke 203 is set to be small in comparison with the gap g4.

Because of this, a magnetic path passing through the cylindrical auxiliary yoke 203 is formed between the movable plunger 215 and the bottom plate portion 202 of the magnetic yoke 201. Furthermore, the gap g1 between the lower surface of the peripheral flange portion 216 of the movable plunger 215 and the upper magnetic yoke 210 is set to be small in comparison with the gap g2 between the outer peripheral surface of the movable plunger 215 and the inner peripheral surface of the through hole 210*a* of the upper magnetic yoke 210. Because of this, the magnetic flux density between the lower surface of the peripheral flange portion 216 of the movable plunger 215 and the upper surface of the upper magnetic yoke 210 increases, and a large suctioning force acts, suctioning the peripheral flange portion 216 of the movable plunger 215.

Consequently, the movable plunger 215 descends swiftly against the biasing force of the return spring 214 and the suctioning force of the annular permanent magnet 220. Because of this, the descent of the movable plunger 215 is stopped by the lower surface of the peripheral flange portion 216 contacting the upper surface of the upper magnetic yoke 210, as shown in FIG. 5B.

As the movable plunger 215 descends in this way, the movable contact 130 connected to the movable plunger 215 via the connecting shaft 131 also descends, and the contact portions 130*a* contacts the contact portions 118*a* of the fixed contacts 111 and 112 with the contact pressure of the contact spring 134.

Because of this, it comes to a closed contact state wherein the large current of the external power supply source is supplied via the fixed contact 111, movable contact 130, and fixed contact 112 to the load.

At this time, an electromagnetic repulsion force is generated between the fixed contacts 111 and 112 and the movable contact 130 in a direction opening the contacts of the movable contact 130.

However, as each of the fixed contacts 111 and 112 includes the C-shaped portion 115 having the upper plate portion 116, intermediate plate portion 117, and lower plate portion 118, as shown in FIG. 1, thereby, the current in the upper plate portion 116 and lower plate portion 118 and the current in the opposing movable contact 130 flow in opposite directions.

Because of this, from the relationship between a magnetic field formed by the lower plate portions 118 of the fixed contacts 111 and 112 and the current flowing through the movable contact 130, it is possible, in accordance with Fleming's left-hand rule, to generate a Lorentz force that presses the movable contact 130 against the contact portions 118*a* of the fixed contacts 111 and 112.

Because of this Lorentz force, it is possible to oppose the electromagnetic repulsion force generated in the contact opening direction between the contact portions 118*a* of the fixed contacts 111 and 112 and the contact portions 130*a* of the movable contact 130, and thus possible to reliably prevent the contact portions 130*a* of the movable contact 130 from opening.

Because of this, it is possible to reduce the pressing force of the contact spring 134 supporting the movable contact 130, and it is also possible to reduce thrust generated in the exciting coil 208, and thus possible to reduce the size of the overall configuration of the electromagnetic contactor.

When interrupting the supply of current to the load in the closed contact state of the contact mechanism 101, the exciting of the exciting coil 208 of the electromagnet unit 200 is stopped.

Because of this, there is no longer an exciting force causing the movable plunger 215 to move downward in the electromagnet unit 200, thereby, the movable plunger 215 is raised by the biasing force of the return spring 214, and as the peripheral flange portion 216 comes close to the auxiliary yoke 225, the suctioning force of the annular permanent magnet 220 increases.

As the movable plunger 215 rises, the movable contact 130 connected via the connecting shaft 131 rises. As a result, the movable contact 130 contacts the fixed contacts 111 and 112 while contact pressure is applied by the contact spring 134. Subsequently, it comes to an opened contact state, wherein the movable contact 130 moves upward from the fixed contacts 111 and 112 when the contact pressure of the contact spring 134 stops.

When the opened contact state starts, an arc is generated between the contact portions 118*a* of the fixed contacts 111 and 112 and the contact portions 130*a* of the movable contact 130, and the state in which current is conducted is continued due to the arc.

At this time, as the insulating cover 121 covering the upper plate portion 116 and intermediate plate portion 117 of the C-shaped portion 115 of each of the fixed contacts 111 and 112, is mounted, it is possible to cause the arc to be generated only between the contact portions 118*a* of the fixed contacts 111 and 112 and the contact portions 130*a* of the movable contact 130. Because of this, it is possible to stabilize the arc generation state, possible to extend the arc to the arc extinguishing space 145 or 146 and extinguish the arc, and thus possible to improve arc extinguishing performance.

Also, as the upper plate portion 116 and intermediate plate portion 117 of the C-shaped portion 115 are covered by the insulating cover 121, it is possible to maintain insulating distance with the insulating cover 121 between the two end portions of the movable contact 130 and the upper plate portion 116 and intermediate plate portion 117 of the C-shaped portion 115, and thus possible to reduce the height in the direction in which the movable contact 130 can move. Consequently, it is possible to reduce the size of the contact device 100.

Furthermore, as the inner surface of the intermediate plate portion 117 of each of the fixed contacts 111 and 112 is covered by the magnetic plate 119, a magnetic field generated by current flowing through the intermediate plate portion 117 is shielded by the magnetic plate 119. Because of this, there is no interference between a magnetic field caused by the arc generated between the contact portions 118*a* of the fixed contacts 111 and 112 and the contact portions 130*a* of the movable contact 130 and the magnetic field generated by the current flowing through the intermediate plate portion 117, and it is thus possible to prevent the arc being affected by the magnetic field generated by the current flowing through the intermediate plate portion 117.

According to the heretofore described embodiment, as the C-shaped portions 115 of the fixed contacts 111 and 112 and the contact spring 134 that provides the contact pressure of the movable contact 130 are disposed in parallel in the contact device 100 in this way, it is possible to reduce the height of the contact mechanism 101 in comparison with a case in which the fixed contacts, the movable contact, and the contact spring are disposed in series. Because of this, it is possible to reduce the size of the contact device 100.

Also, the arc extinguishing chamber 102 is formed by brazing the metal tubular body 104 and the plate-like fixed contact support insulating substrate 105, which closes off the upper end of the metal tubular body 104 and in which the fixed contacts 111 and 112 are fixed and held by brazing. Because of this, fixed contact support insulating substrates 105 can be arrayed in close contact vertically and horizontally on the same flat surface, it is possible to carry out a metalizing process on a plurality of fixed contact support insulating substrates 105 at one time, and thus possible to improve productivity.

Also, it is possible to braze the fixed contact support insulating substrate 105 to the metal tubular body 104 after the fixed contacts 111 and 112 are brazed to and supported in the fixed contact support insulating substrate 105, possible to easily carry out the fixing and holding of the fixed contacts 111 and 112 and, as a simple configuration is sufficient for the brazing jig, possible to achieve a reduction in cost of the assembly jigs.

Suppression and management of flatness and warpage for the fixed contact support insulating substrate 105 are also easy in comparison with a case in which the arc extinguishing chamber 102 is formed in a tub-form. Furthermore, it is possible to fabricate a large number of the arc extinguishing chamber 102 at one time, and thus possible to reduce fabrication costs.

Also, with regard to the electromagnet unit 200, the annular permanent magnet 220 magnetized in the direction in which the movable plunger 215 can move is disposed on the upper magnetic yoke 210, and the auxiliary yoke 225 is formed on the upper surface of the annular permanent magnet 220, thereby it is possible to generate suctioning force that suctions the peripheral flange portion 216 of the movable plunger 215 with the one annular permanent magnet 220.

Because of this, it is possible to carry out the fixing of the movable plunger 215 in the released state with the magnetic force of the annular permanent magnet 220 and the biasing force of the return spring 214, thereby it is possible to improve holding force with respect to malfunction shock.

Also, it is possible to reduce the biasing force of the return spring 214, and thus possible to reduce the total load of the contact spring 134 and return spring 214. Consequently, it is possible to reduce the suctioning force generated in the exciting coil 208 in accordance with the amount by which the total load is reduced, and thus possible to reduce the magnetomotive force of the exciting coil 208. Because of this, it is possible to reduce the length in the axial direction of the spool 204, and thus possible to reduce the height of the electromagnet unit 200 in the direction in which the movable plunger 215 can move.

Furthermore, as the auxiliary yoke 225 is integrally formed by the rectangular flat plate portion 225*a* and the stepped plate portion 225*c* having the central aperture 225*b*, it is possible to increase the rigidity in comparison with a case in which the auxiliary yoke 225 is formed by only the rectangular flat plate portion 225*a*, and thus possible to prevent deformation of the auxiliary yoke 225. Because of this, the movable plunger 215 moves upward due to the elasticity of the return spring 214 and the magnetic force of the annular permanent magnet 220 when switching from an engaged state to a released state, and the upper surface of the peripheral flange portion 216 of the movable plunger 215 abuts the lower surface of the stepped plate portion 225*c* of the auxiliary yoke 225, but as the rigidity of the auxiliary yoke 225 is high, it is possible to accurately regulate the released position of the movable plunger 215.

Moreover, as the stepped plate portion 225*c* is formed in the auxiliary yoke 225, the height of the annular permanent magnet 220 can be arbitrarily set in accordance with the necessary magnetic force, regardless of the stroke L of the movable plunger 215 and the thickness t of the peripheral flange portion 216, and regulating final position can be carried out by the height y of the stepped plate portion 225*c* of the auxiliary yoke 225.

Because of this, it is possible to minimize the cumulative number of parts and form tolerance, affecting the stroke of the movable plunger 215. Moreover, as the regulation of the stroke of the movable plunger 215 is carried out by only the thickness of the annular permanent magnet 220 and the thickness of the peripheral flange portion 216 of the movable plunger 215, it is possible to minimize variation of the stroke.

Also, as the rectangular flat plate portion 225*a*, central aperture 225*b*, and stepped plate portion 225*c* are integrally formed by pressing the auxiliary yoke 225, the auxiliary yoke 225 can easily be formed with one part.

Also, as the thickness of the peripheral flange portion 216 of the movable plunger 215 can be set to the minimum necessary thickness, it is possible to reduce the mass of the movable plunger 215, and it is also possible to reduce the elasticity of the return spring 214, and thus reduce the overall weight and size.

As it is possible to reduce the height in the direction in which the movable plunger 215 can move in both the contact device 100 and electromagnet unit 200 in this way, it is possible to considerably shorten the overall configuration of the electromagnetic contactor 10, and thus possible to achieve a reduction in size.

Furthermore, due to the peripheral flange portion 216 of the movable plunger 215 disposed inside the inner peripheral surface of the annular permanent magnet 220, there is no waste in a closed circuit passing magnetic flux generated by the annular permanent magnet 220, leakage magnetic flux decreases, and it is possible to use the magnetic force of the permanent magnet efficiently.

Figure 6:
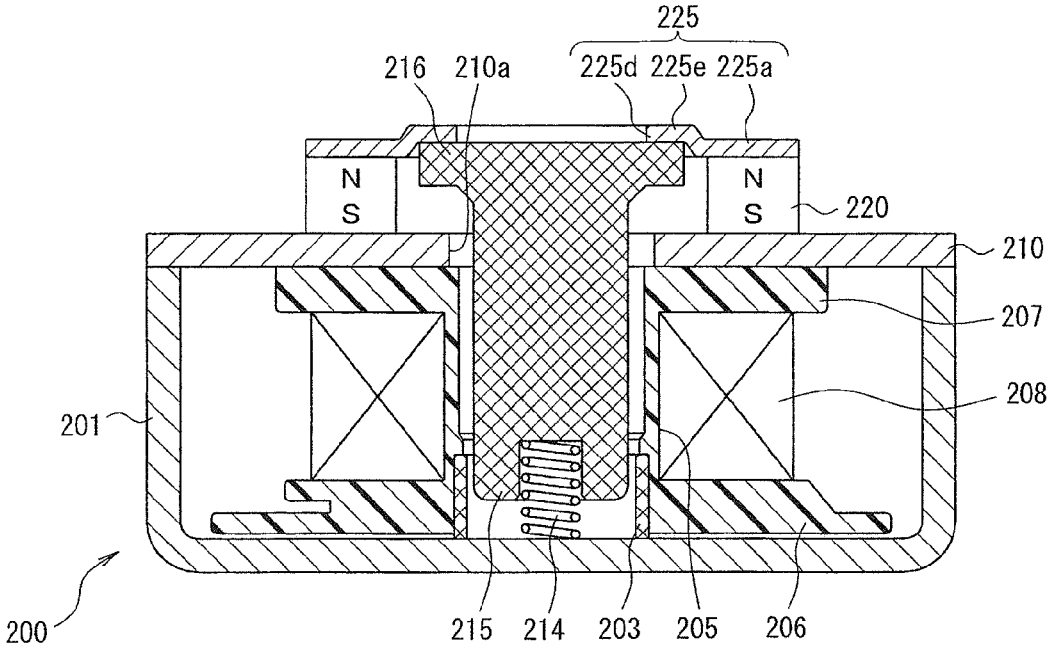
FIG. 6 is a sectional view the same as FIG. 8A, showing another embodiment of the auxiliary yoke.

In the embodiment, a description has been given of a case wherein the thickness T of the annular permanent magnet 220 is large. However, the invention is not limited to the heretofore described configuration, and is formed as shown in FIG. 6, when the thickness T of the annular permanent magnet 220 is small and it is not possible to secure the stroke L of the movable plunger 215. That is, the configuration may be formed such that a stepped plate portion 225*e* in which a central aperture 225*d* of the auxiliary yoke 225 is formed protrudes upward beyond the rectangular flat plate portion 225*a*, and the stroke L of the movable plunger 215 is secured by the height y from the lower surface of the rectangular flat plate portion 225*a* to the lower surface of the stepped plate portion 225*e* of the auxiliary yoke 225.

Figure 7:
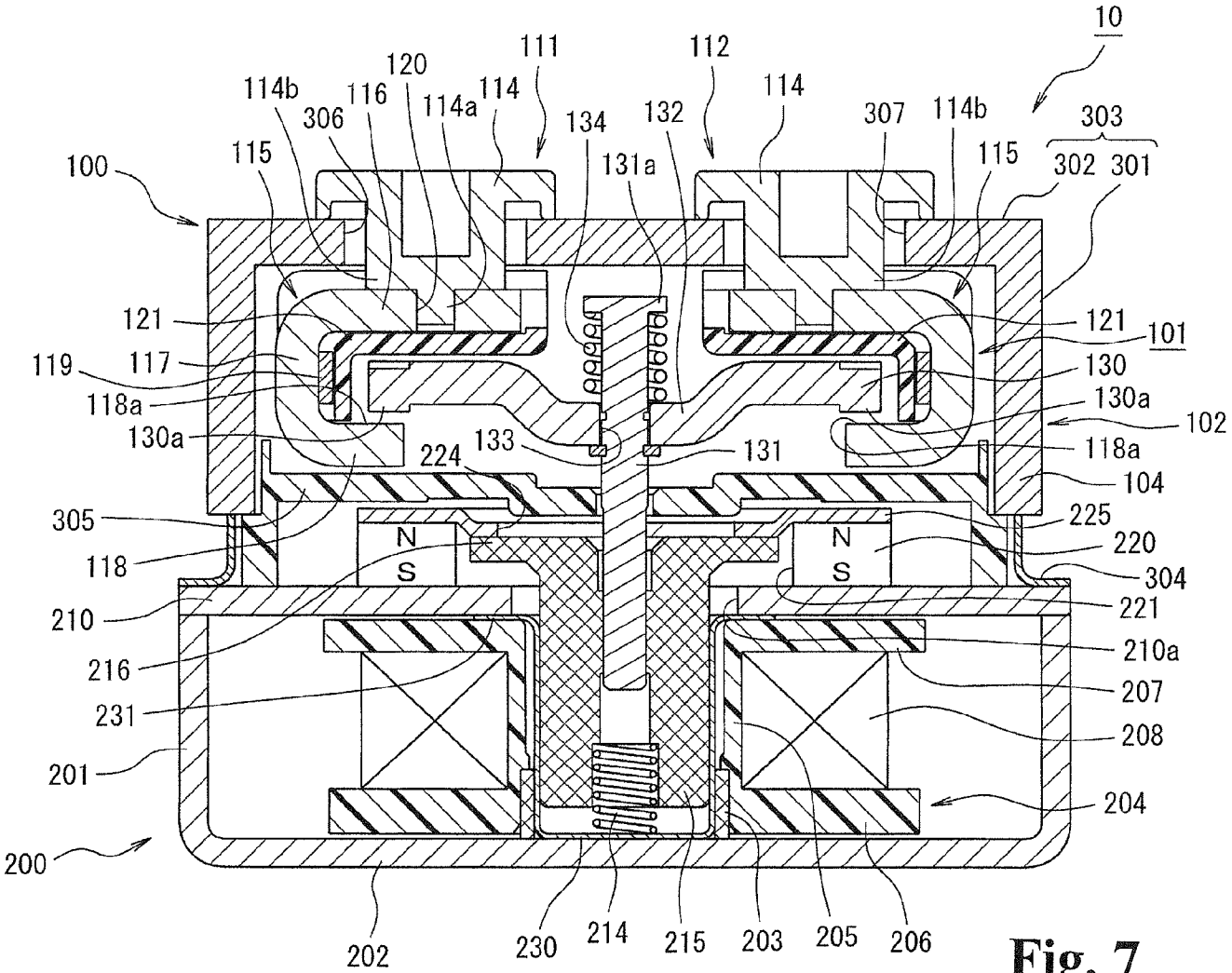
FIG. 7 is a sectional view showing another example of the arc extinguishing chamber in a contact device of the invention.

Also, in the embodiment, a description has been given of a case in which the arc extinguishing chamber 102 of the contact device 100 is formed by the metal tubular body 104 and fixed contact support insulating substrate 105 but, not limited to this, and other configurations can be adopted. For example, as shown in FIG. 7 and FIG. 2B, the configuration may be formed such that a tubular portion 301 and an upper surface plate portion 302 closing off the upper end of the tubular portion 301 are formed integrally by a ceramic or a synthetic resin material, thereby forming a tub-form body 303, a metal foil is formed on an opened end surface side of the tub-form body 303 by a metalizing process, and a metal connection member 304 is seal-joined to the metal foil, thus forming the arc extinguishing chamber 102.

Also, the contact mechanism 101 is not limited to the configuration of the embodiment, and it is possible to apply a contact mechanism of an arbitrary configuration.

Figure 8A:
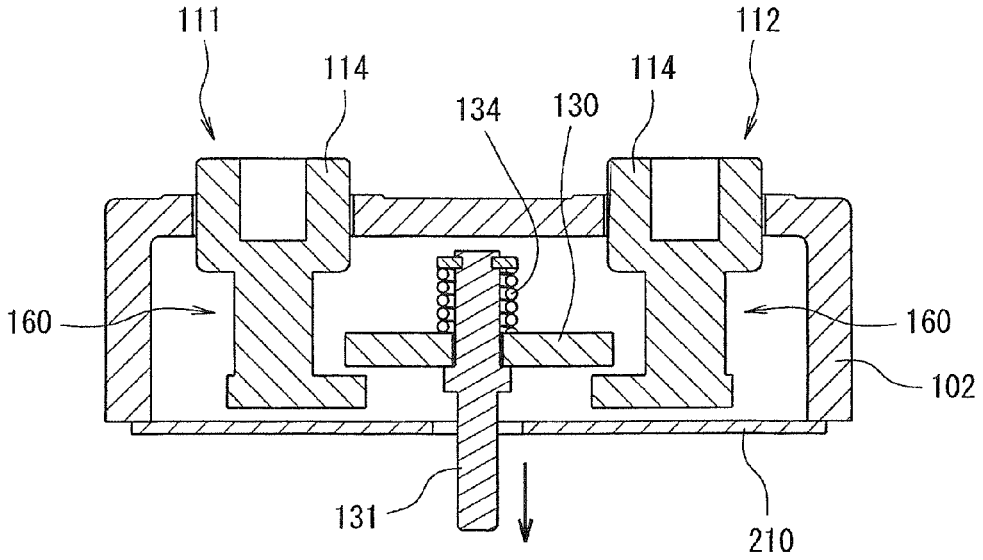
Figure 8B:
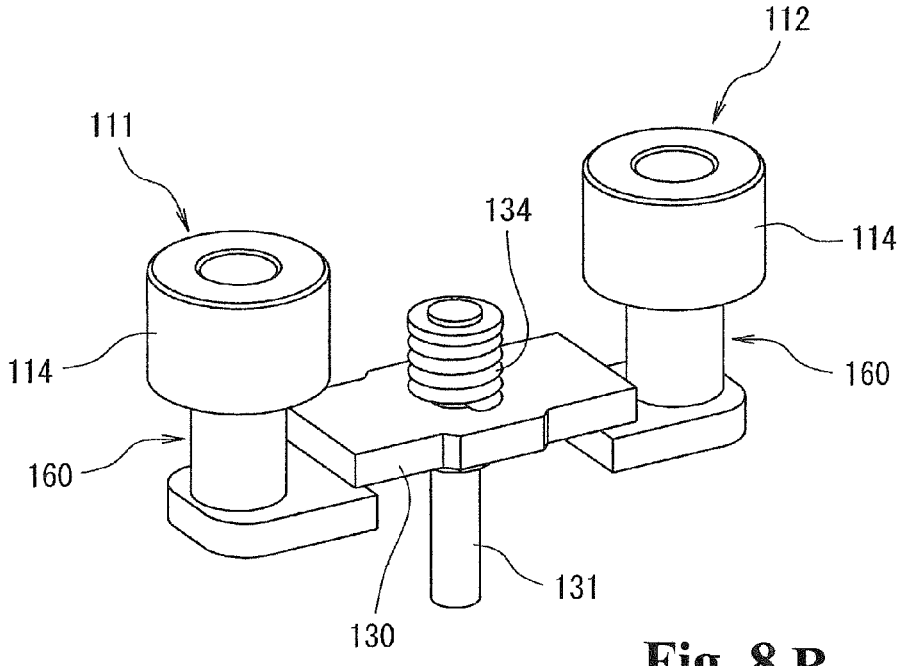

For example, a configuration wherein an L-shaped portion 160, wherein the upper plate portion 116 in the C-shaped portion 115 is omitted, is connected to the support conductor portion 114 may be adopted, as shown in FIGS. 8A and 8B. In this case, in a closed contact state wherein the movable contact 130 contacts the fixed contacts 111 and 112, it is possible to cause magnetic flux generated by current flowing through the vertical plate portion of the L-shaped portion 160 to act on portions wherein the fixed contacts 111 and 112 and movable contact 130 are in contact. Because of this, it is possible to increase the magnetic flux density in the portions wherein the fixed contacts 111 and 112 and movable contact 130 contact each other, thus generating a Lorentz force that opposes the electromagnetic repulsion force.

Figure 9A:
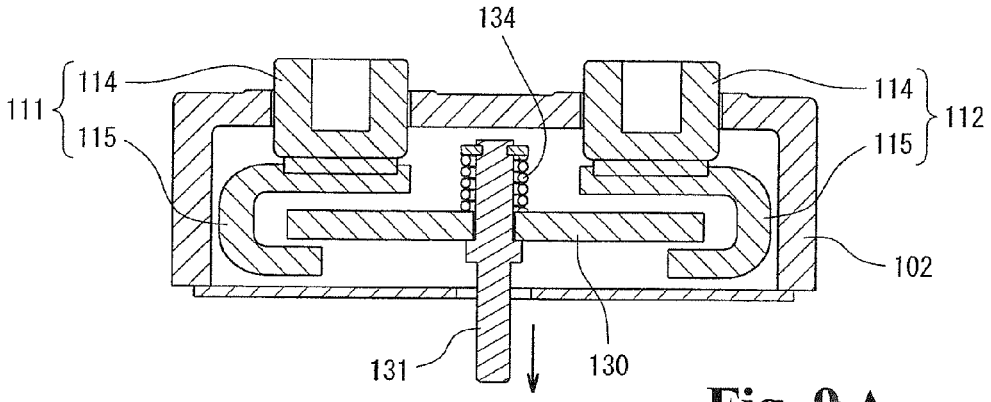
Figure 9B:
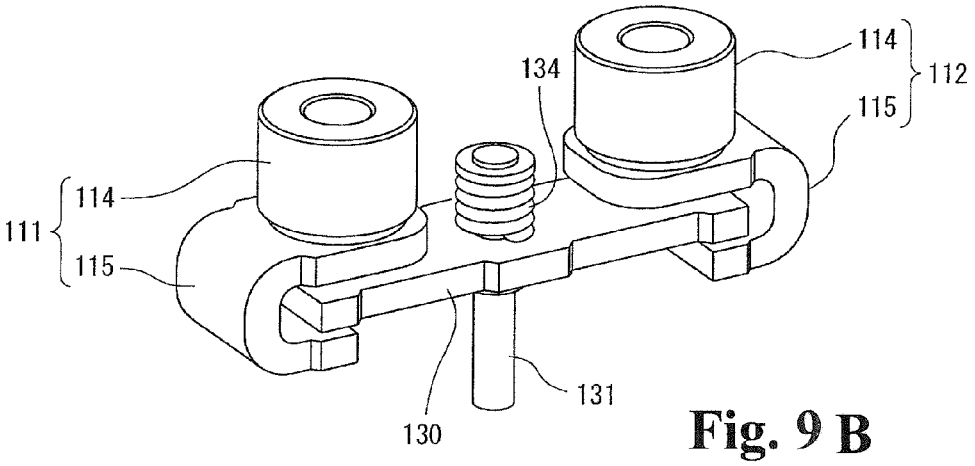

Also, the depressed portion 132 may be omitted, forming a flat plate, as shown in FIGS. 9A and 9B.

Also, in the embodiment, a description has been given of a case wherein the connecting shaft 131 is screwed to the movable plunger 215 but, not limited to screwing, and an arbitrary connection method can be applied, and furthermore, the movable plunger 215 and connecting shaft 131 may also be formed integrally.

Also, a description has been given of a case in which the connecting shaft 131 and movable contact 130 are connected such that the flange portion 131*a* is formed on the leading end portion of the connecting shaft 131, and the lower end of the movable contact 130 is fixed with a C-ring after the connecting shaft 131 is inserted into the contact spring 134 and movable contact 130, but the connection is not limited to this. That is, the connection may be formed such that a positioning large diameter portion is formed in the C-ring position of the connecting shaft 131 to protrude in a radial direction, the contact spring 134 is disposed after the movable contact 130 contacts the large diameter portion, and the upper end of the contact spring 134 is fixed with the C-ring.

Figure 10A:
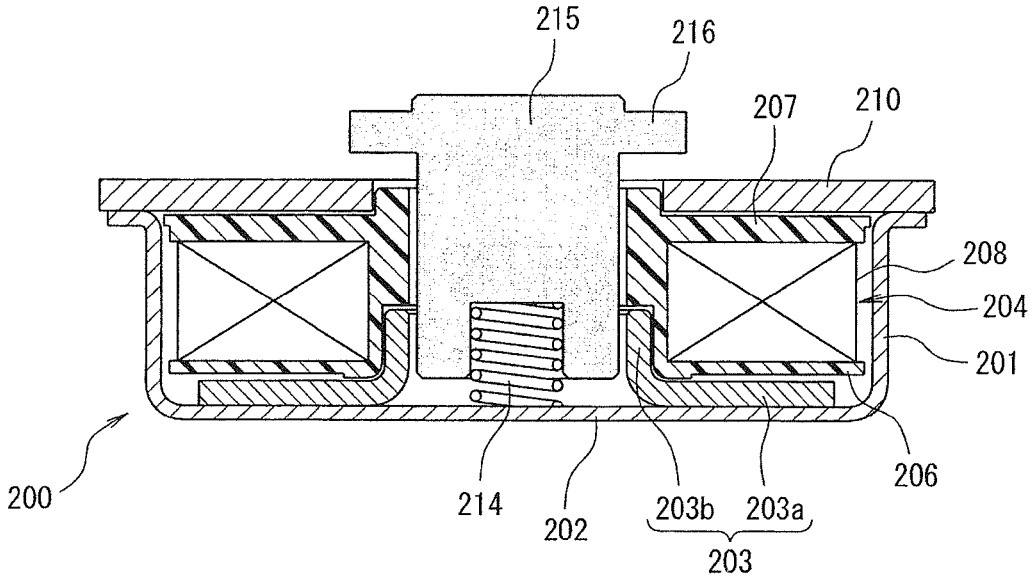
Figure 10B:
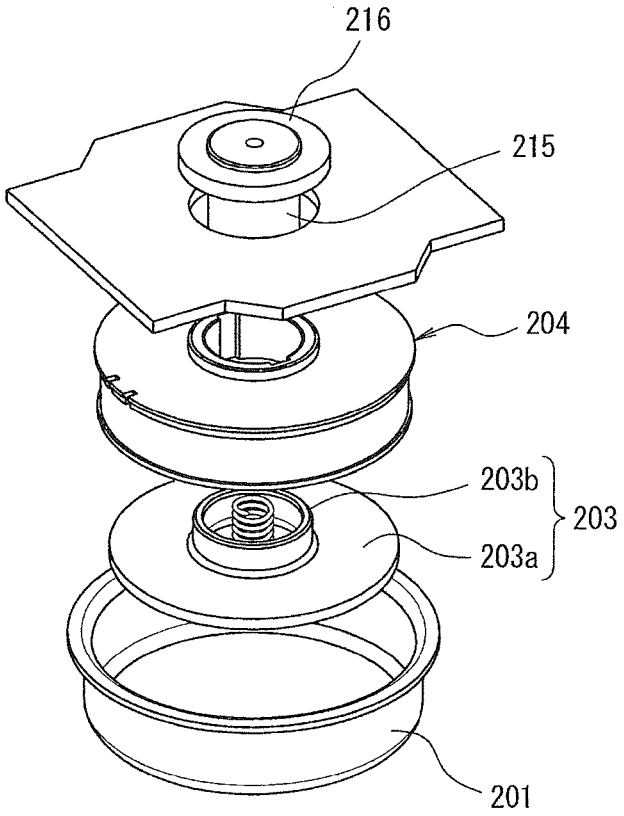

Also, in the embodiment, a description has been given of a case in which the cylindrical auxiliary yoke 203 is disposed in proximity to the lower end side of the movable plunger 215, but not limited to this. That is, the magnetic yoke 201 may be formed in a bottomed cylindrical form, as shown in FIGS. 10A and 10B, and the cylindrical auxiliary yoke 203 may be formed by an annular plate portion 203*a* extending along the bottom plate portion 202 of the magnetic yoke 201, and a cylindrical portion 203*b* rising upward from the inner peripheral surface of the annular plate portion 203*a*.

Figure 11A:
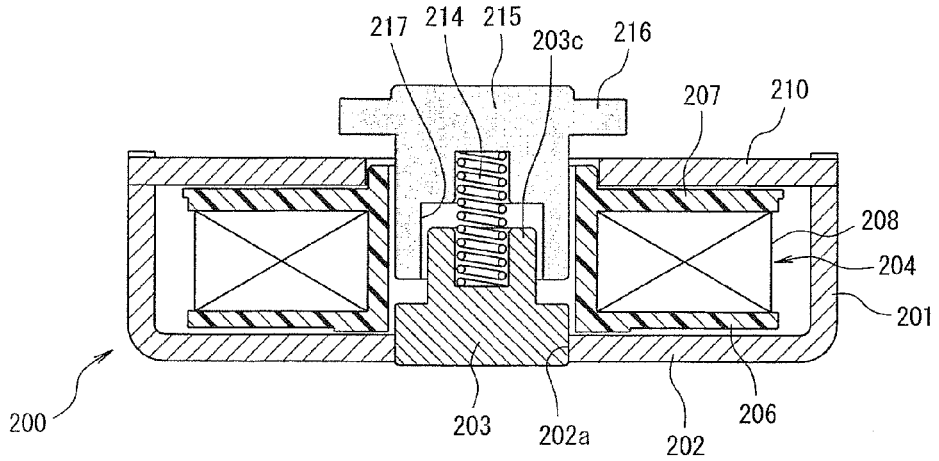
Figure 11B:
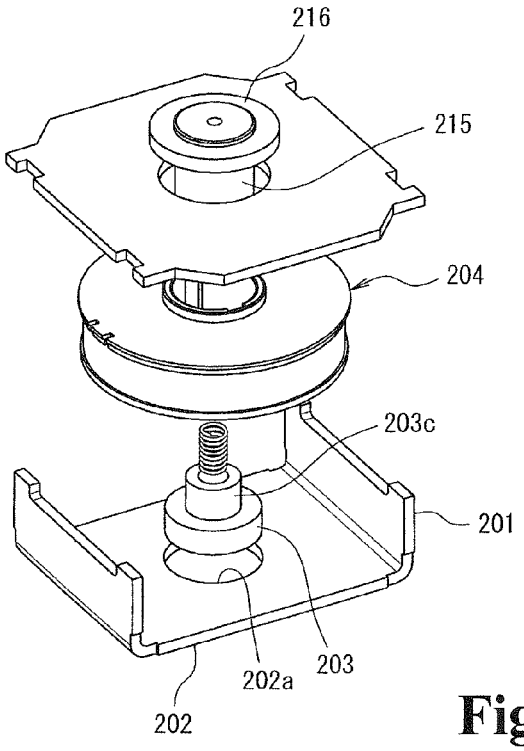

Also, as shown in FIGS. 11A and 11B, the configuration may be formed such that a through hole 202*a* is formed in the bottom plate portion 202 of the U-shaped magnetic yoke 210, the cylindrical auxiliary yoke 203 has a protruding form and is fitted inside the through hole 202*a*, and a small diameter portion 203*c* of the cylindrical auxiliary yoke 203 is inserted into an insertion hole 217 formed in the movable plunger 215.

Also, in the embodiment, a description has been given of a case in which a hermetic receptacle is formed by the arc extinguishing chamber 102 and cap 230, and gas is encapsulated inside the hermetic receptacle, but not limited to this, and the gas encapsulation may be omitted when the interrupted current is small.

INDUSTRIAL APPLICABILITY

According to the invention, it is possible to provide an electromagnetic contactor such that, without using a plurality of permanent magnets, it is possible to secure the necessary magnetic force with one permanent magnet, and to use the magnetic force of the permanent magnet efficiently.

REFERENCE SIGNS LIST

10 . . . Electromagnetic contactor, 11 . . . External insulating receptacle, 100 . . . Contact device, 101 . . . Contact mechanism, 102 . . . Arc extinguishing chamber, 104 . . . Metal tubular body, 105 . . . Fixed contact support insulating substrate, 111, 112 . . . Fixed contact, 114 . . . Support conductor portion, 115 . . . C-shaped portion, 116 . . . Upper plate portion, 117 . . . Intermediate plate portion, 118 . . . Lower plate portion, 118*a* . . . Contact portion, 121 . . . Insulating cover, 122 . . . L-shaped plate portion, 123, 124 . . . Side plate portion, 125 . . . Fitting portion, 130 . . . Movable contact, 130*a* . . . Contact portion, 131 . . . Connecting shaft, 132 . . . Depressed portion, 134 . . . Contact spring, 140 . . . Insulating cylinder, 141, 142 . . . Magnet housing pocket, 143, 144 . . . Arc extinguishing permanent magnet, 145, 146 . . . Arc extinguishing space, 160 . . . L-shaped portion, 200 . . . Electromagnet unit, 201 . . . Magnetic yoke, 203 . . . Cylindrical auxiliary yoke, 204 . . . Spool, 208 . . . Exciting coil, 210 . . . Upper magnetic yoke, 214 . . . Return spring, 215 . . . Movable plunger, 216 . . . Peripheral flange portion, 220 . . . Annular permanent magnet, 225 . . . Auxiliary yoke, 225*a* . . . Rectangular flat plate portion, 225*b* . . . Central aperture, 225*c* . . . Stepped plate portion, 225*d* . . . Central aperture, 225*e* . . . Stepped plate portion

What is claimed is:

1. An electromagnetic contactor, comprising:

a pair of fixed contacts disposed to maintain a predetermined interval and a movable contact disposed so as to be attachable to and detachable from the pair of fixed contacts; and an electromagnet unit that drives the movable contact, including:

a magnetic yoke enclosing a plunger drive portion, a movable plunger having a leading end protruding through an aperture formed in the magnetic yoke, the movable plunger supporting the movable contact via a connecting shaft and being urged by a return spring, an annular permanent magnet fixedly disposed so as to enclose a peripheral flange portion formed on a protruding end side of the movable plunger and magnetized in a direction in which the movable plunger can move, and an auxiliary yoke disposed on the annular permanent magnet at a side opposite to that of the magnetic yoke and regulating a movement of the peripheral flange portion of the movable plunger, wherein the auxiliary yoke includes a stepped plate portion formed in a central portion of a flat plate portion to protrude and having an aperture through which the connecting shaft is inserted.

2. The electromagnetic contactor according to claim 1, wherein the auxiliary yoke is formed such that the flat plate portion and stepped plate portion are integrally formed by pressing.

3. The electromagnetic contactor according to claim 1, wherein a height of the stepped plate portion is determined in accordance with a stroke necessary for the movable plunger.

* * * * *